US010233776B2

(12) United States Patent
Pula et al.

(10) Patent No.: US 10,233,776 B2
(45) Date of Patent: Mar. 19, 2019

(54) GAS TURBINE RING SEGMENT COOLING APPARATUS

(71) Applicant: Siemens Energy, Inc., Orlando, FL (US)

(72) Inventors: John Pula, Jupiter, FL (US); Andrew R. Narcus, Loxahatchee, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 635 days.

(21) Appl. No.: 14/890,604

(22) PCT Filed: May 20, 2014

(86) PCT No.: PCT/US2014/038695

§ 371 (c)(1),
(2) Date: Nov. 12, 2015

(87) PCT Pub. No.: WO2014/189873

PCT Pub. Date: Nov. 27, 2014

(65) Prior Publication Data

US 2016/0084109 A1 Mar. 24, 2016

Related U.S. Application Data

(60) Provisional application No. 61/825,598, filed on May 21, 2013.

(51) Int. Cl.
*F01D 11/08* (2006.01)
*F01D 25/12* (2006.01)

(52) U.S. Cl.
CPC ..... *F01D 25/12* (2013.01); *F01D 11/08* (2013.01); *F05D 2240/11* (2013.01)

(58) Field of Classification Search
CPC ..... F01D 25/12; F01D 11/08; F01D 11/24; F05D 2240/11
See application file for complete search history.

(56) References Cited

U.S. PATENT DOCUMENTS 3,141,651 A 7/1964 Moyer
4,784,569 A 11/1988 Sidenstick et al.
(Continued)

FOREIGN PATENT DOCUMENTS

DE 1426804 A1 3/1969
EP 1443182 A2 8/2004
JP S5910706 A 1/1984

*Primary Examiner* — Justin Seabe
*Assistant Examiner* — Sabbir Hasan

(57) ABSTRACT

A gas turbine shroud ring segment assembly (36) with an outer structural block (32A) having cooling channels (72) between inlets (60) on a front face and outlets (74, 76) on a front hanger rail (48). The outlets may be positioned on a radially inner surface (77) of the front rail for impingement and forced convection cooling of backsides of radially inner front lips (44) of adjacent shroud ring segments (30A, 30B) mounted on front and rear rails (48, 50) of the block. The outlets may enter a pocket (86) on the inner surface configured to allow coolant flow in all positions of the ring segments (32A, 32B). The cooling channel may form a main channel (72A) and tributary channels (72B, 72C). These channels may be drilled upward from the rail to the inlet. The tributaries may have offset intersections (72E, 72D) with the main channel.

10 Claims, 5 Drawing Sheets

(56) References Cited

U.S. PATENT DOCUMENTS

| | | | | |
|---|---|---|---|---|
| 5,165,847 | A | 11/1992 | Proctor et al. | |
| 6,126,389 | A | 10/2000 | Burdgick | |
| 6,139,257 | A | 10/2000 | Proctor et al. | |
| 6,402,466 | B1 | 6/2002 | Burdgick et al. | |
| 6,554,566 | B1 * | 4/2003 | Nigmatulin | F01D 11/08 415/139 |
| 7,063,503 | B2 * | 6/2006 | Meisels | F01D 25/24 415/116 |
| 7,131,814 | B2 | 11/2006 | Nagler et al. | |
| 7,377,742 | B2 | 5/2008 | Shapiro et al. | |
| 7,553,128 | B2 | 6/2009 | Abdel-Messeh et al. | |
| 2005/0232752 | A1 | 10/2005 | Meisels | |
| 2007/0009349 | A1 | 1/2007 | Ward, Jr. et al. | |
| 2007/0280820 | A1 | 12/2007 | Roberts et al. | |
| 2009/0081033 | A1 | 3/2009 | Schiavo et al. | |

* cited by examiner

GAS TURBINE RING SEGMENT COOLING APPARATUS

CROSS REFERENCE TO RELATED APPLICATIONS

This application is the US National Stage of International Application No. PCT/US2014/038695 filed May 20, 2014, and claims the benefit thereof. The International Application claims benefit of the 21 May 2013 filing date of U.S. provisional patent application No. 61/825,598. All applications are incorporated by reference herein.

FIELD OF THE INVENTION

The invention relates generally to cooling of gas turbine shroud ring segments, and more particularly to cooling channels in the supporting outer structural blocks of stage 1 ring segments.

BACKGROUND OF THE INVENTION

The turbine section of a gas turbine engine has circular arrays of blades mounted on rotating disks. The tips of the blades are closely surrounded by a shroud ring formed of a circular array of shroud ring segments. The shroud ring bounds the working gas flow. The ring segments are supported by a radially outer ring structure made of a circular array of support blocks connected to the turbine casing. Each support block may mount multiple ring segments. Each ring segment may have a radially inner lip extending forward of a structural frame on the backside of the ring segment. The term "backside" herein means a radially outer or distal side of a shroud ring component with respect to the turbine axis. The terms "forward", "front", "fore", and "aft" herein mean upstream (forward, front, fore) and downstream (aft) with respect to the working gas flow. The radially inner front lips of the ring segments are more susceptible to heat damage and wear from hot combustion gas, which can intrude to the backside of the lip due to high static and dynamic pressure, especially at stage 1 of the turbine section. Combustion gas can further intrude into gaps between adjacent ring segments. It can cause heat damage, including cyclic thermal expansion fatigue that can initiate cracks and other degradation in the ring segment or support block.

BRIEF DESCRIPTION OF THE DRAWINGS

The invention is explained in the following description in view of the drawings that show.

DETAILED DESCRIPTION OF THE INVENTION

Figure 1:
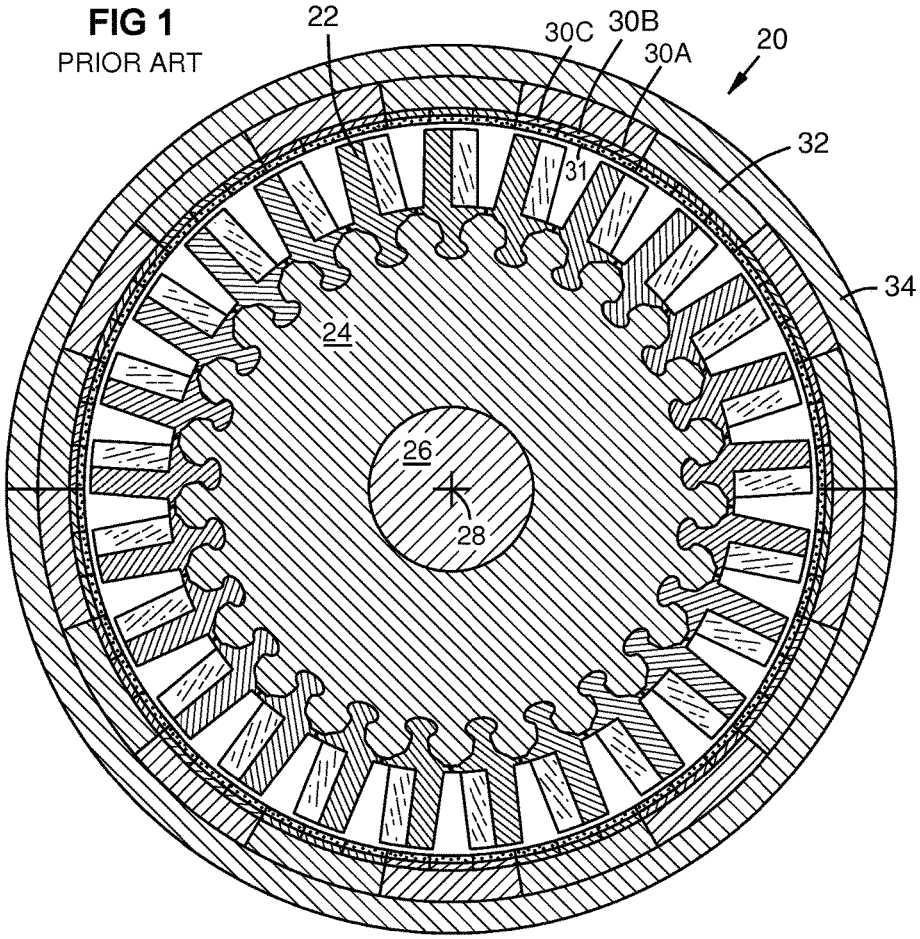
FIG 1 PRIOR ART
FIG. 1 is a sectional view of a prior art disk of a turbine section of a gas turbine engine.

FIG. 1 is a sectional view of a disk 24 of a turbine stage 20 of a gas turbine engine. The disk 24 has a shaft 26 with a rotation axis 28. Blades 22 are mounted around the circumference of the disk. The blades are closely surrounded by a shroud ring formed of a circular array of inner shroud ring segments 30A-C mounted on outer structural blocks 32, which are in turn are mounted on the engine casing 34. In this context, "outer" and "inner" mean radially outer and inner with respect to the axis 28. The inner surfaces 31 of the inner ring segments 30A-C may have a thermal barrier coating.

Figure 2:
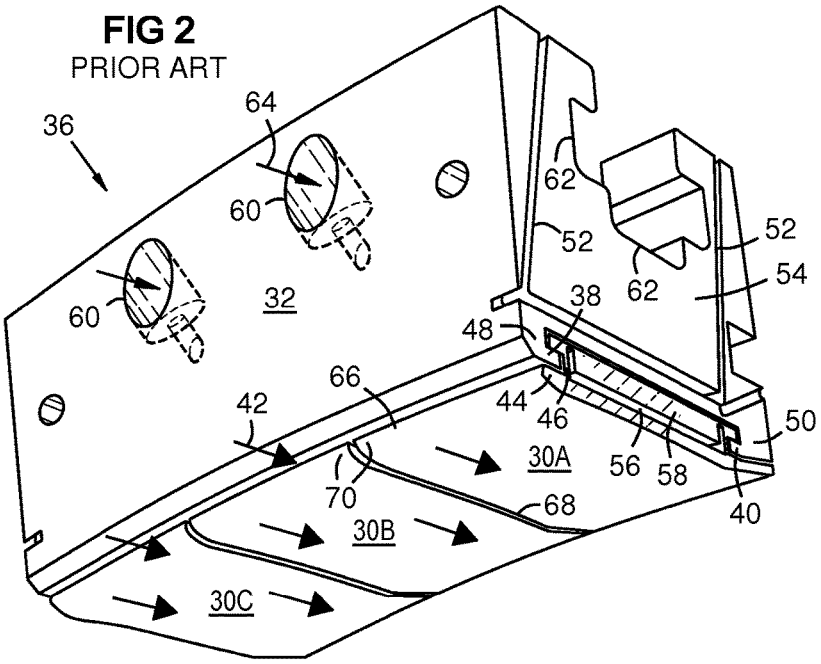
FIG 2 PRIOR ART
FIG. 2 is a perspective view of a prior art shroud ring segment assembly for a gas turbine.

FIG. 2 shows a prior art shroud ring segment assembly 36 for a first turbine stage, which is the first stage after the combustion section (not shown). Inner ring segments 30A-C are mounted on the structural block 32 by a shroud ring segment mounting device which includes a fore hook 38 and an aft hook 40 on the radially inner side of an outer structural block 32. The hooks 38, 40 are part of respective circumferentially oriented fore and aft hanger rails 48, 50 that slidably receive the inner ring segments 30A-C. The ring segments surround and contain the combustion gas flow 42. Each ring segment has a radially inner front lip 44 that extends forward of a structural frame 46 of the ring segment. Seal slots 52 may be provided on the circumferential faces 54 of the block 32 for sealing against adjacent blocks. Seal slots 56 may be provided on the circumferential faces 58 of the ring segments 30A-C for sealing against adjacent ring segments. Coolant inlets 60 on the front face of the block communicate with a cooling plenum 62 in the block. Compressed air 64 from a compressor of the engine enters the inlets 60 via an air supply plenum in the combustion section, thence enters the block plenum 62 to cool the block 32 and the ring segments 30A-C mounted thereon.

Combustion gas 42 at high pressure and temperature strikes the leading edges 66 of the ring segments of turbine stage 1. This can cause heat damage to the front lips 44, and can intrude into the gaps 68 between adjacent ring segments, overheating structures outside the combustion gas path. The corners 70 of the front lips 44 are especially susceptible to heat damage. The compressed cooling air 64 has higher static pressure than the combustion gas 42. However, the coolant currently does not optimally reach the front lips 44, and especially the front corners 70 thereof.

Figure 3:
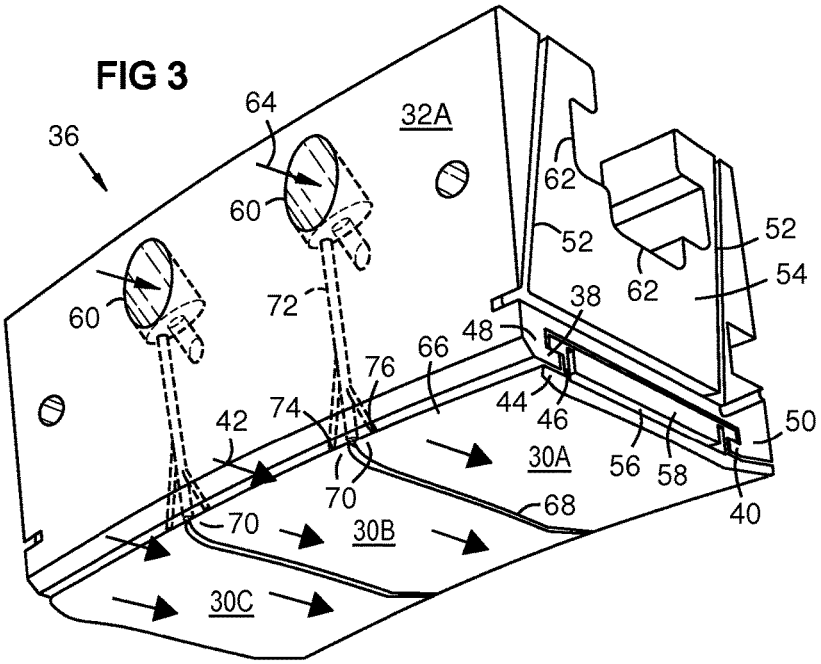
FIG. 3 is a perspective view of a shroud ring segment assembly showing aspects of an embodiment of the invention.

FIG. 3 shows an embodiment of an outer structural block 32A with aspects of the invention. A cooling channel 72 routes coolant 64 from the inlet 60 on the front face of the structural block 32 to at least one outlet 74, 76 on a radially inner surface of the fore hanger rail 48. As shown, two outlets 74, 76 are directed toward the backsides of the front lips 44 of two adjacent ring segments 30A, 30B. The outlets may be opposite the corners 70, thus cooling these critical and hard-to-cool areas. The channel 72 may be formed in the block of FIG. 2 by drilling upward from below prior to attachment of the ring segments, and thus may modify and improve the existing cooling configuration of the prior art block of FIG. 2.

Figure 4:
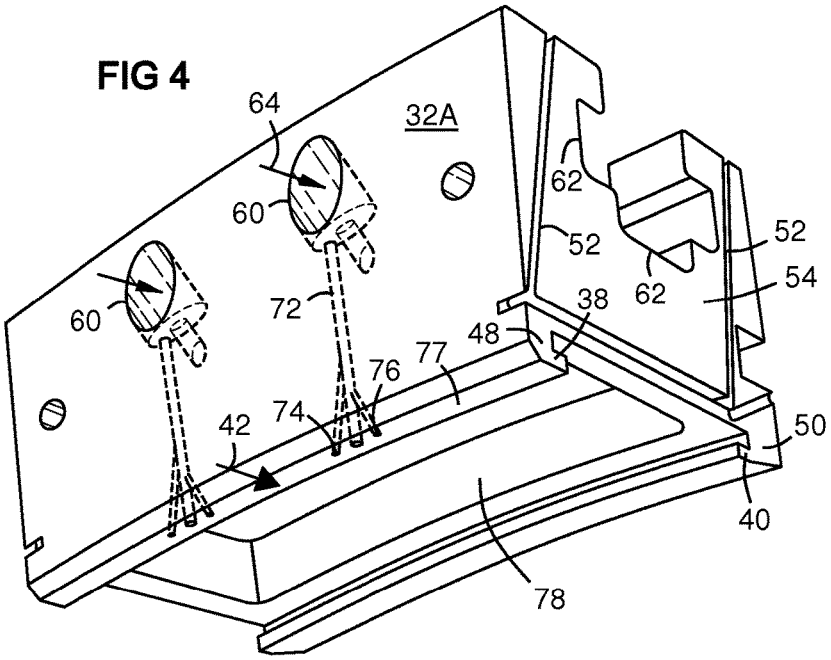
FIG. 4 is a perspective view of an outer structural block of the assembly of FIG. 3.
Figure 5:
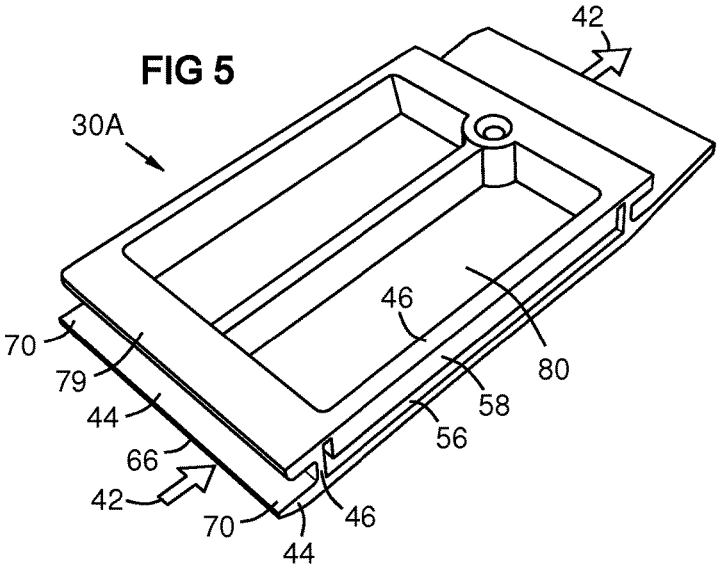
FIG. 5 is a perspective view of an inner ring segment of the assembly of FIG. 3.

FIG. 4 shows the structural block 32A without attached ring segments. It may have a second plenum 78 that receives coolant communicated from the first plenum for cooling the ring segments. The front hanger rail 48 has a hook 38 and an inner surface 77 with coolant outlets 74, 76. FIG. 5 shows a backside of a ring segment 30A with a structural frame 46 and cooled backside areas 80. Two front lips 44, 79 are shown. The front lip of main concern is the radially innermost front lip 44 that extends forward of the front perimeter of the structural frame 46 of the ring segment 30A and borders the combustion gas flow 42, forming part of the working gas liner.

Figure 6:
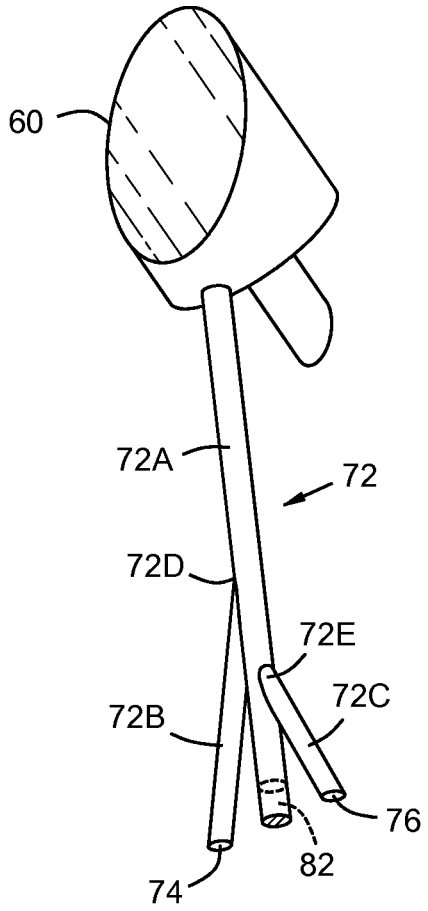
FIG. 6 is a perspective view of cooling channel surface geometry showing aspects of an embodiment of the invention.

FIG. 6 shows the surface geometry of an embodiment of the cooling channel 72. It may have a main channel 72A and one or more tributary channels 72B, 72C. The main channel may be drilled upward from the radially inner surface 77 of the fore rail 46 (FIG. 4) to meet the coolant inlet 60. The tributary channels may be drilled upward from the radially inner surface of the fore rail to intersect the main channel 72A. The main channel may then be plugged 82 downstream of the intersections 72D, 72E of the tributaries. This provides metered coolant flow to two adjacent front corners of adjacent ring segments as previously shown. The intersections 72E, 72D may be offset from each other along a length of the main channel 72A by a distance of at least one diameter of the main channel in order to eliminate fluid dynamics interference effects between the two intersections that could reduce flow to one of the tributaries.

Figure 7:
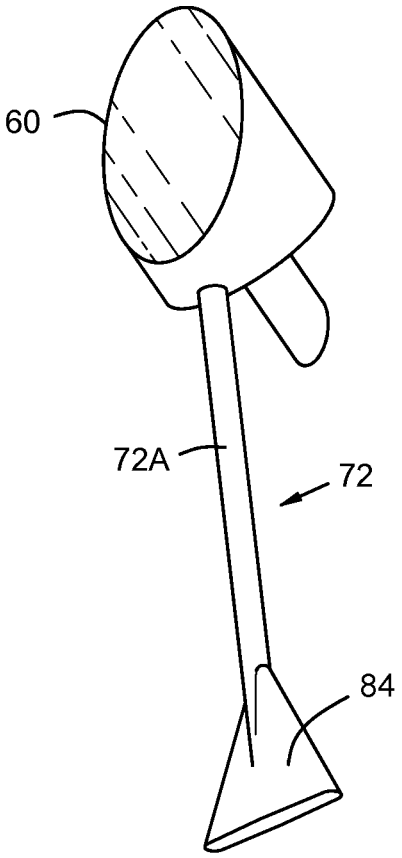
FIG. 7 is a perspective view of cooling channel surface geometry showing aspects of another embodiment of the invention.

FIG. 7 shows a second embodiment of the cooling channel 72 with a flared outlet 84, which may be fan-shaped as shown. This provides forced convection and impingement cooling across the backsides of two adjacent front corners of ring segments and the gap between them. It pressurizes the front end of the gap to block intrusion of combustion gas. The main channel 72A may be drilled upward from the radially inner surface 77 of the fore rail 46 (FIG. 4) to meet the coolant inlet 60. The lower end of the main channel may then be widened into the flared outlet 84 by milling.

Figure 8:
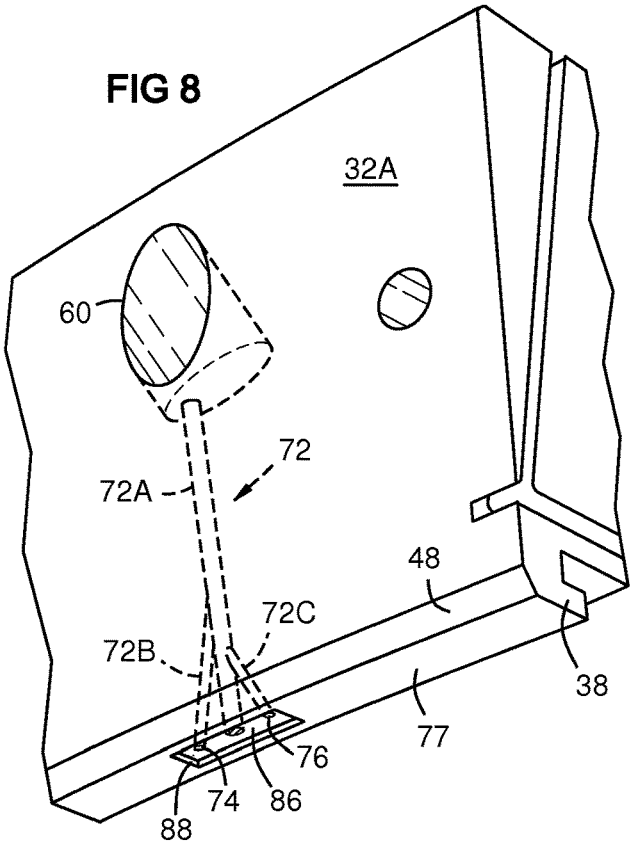
FIG. 8 is a partial perspective view of a front wall of an outer structural block of the assembly of FIG. 3 showing coolant channels with an outlet pocket according to an embodiment of the invention.

FIG. 8 shows an embodiment in which the cooling channels 72B, 72C open into a pocket 86 formed by a depression with a bounding wall 88 around the outlets 74, 76. The depression may have a substantially uniform shallow depth not greater than twice the diameter of the outlets 74, 76, so the outlets are positioned for close impingement cooling of the backsides of the front lips of the adjacent ring segments 30A, 30B (FIG. 3). Without the pocket, if the outlet of the main channel 72A is intentionally plugged as previously described, the coolant flow would be blocked when the front lips of the ring segments are tight against the inner surface 77 of the rail 48. In this condition, the pocket 86 provides a coolant flow path to the gap 68 (FIG. 3) between ring segments, thus continuing to cool the lips 44 and pressurize the gap to prevent hot gas ingestion.

Figure 9:
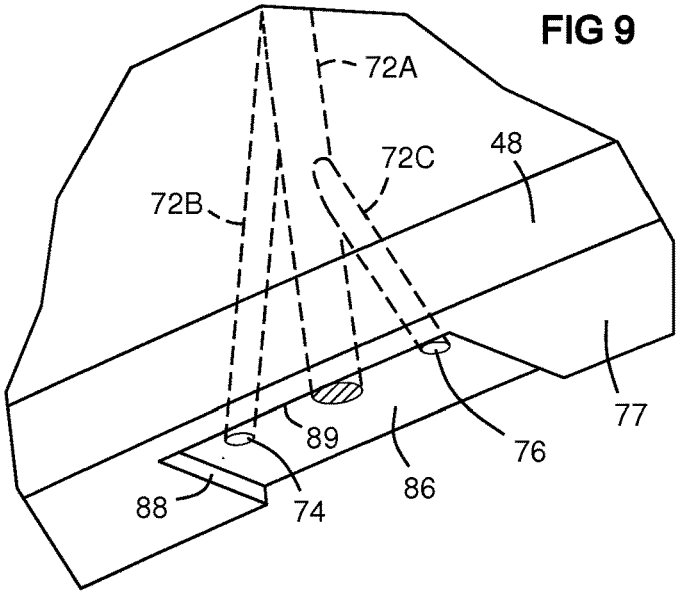
FIG. 9 is a partial perspective view of a front wall of an outer structural block of the assembly of FIG. 3 showing coolant channels with an outlet pocket according to another embodiment of the invention.

FIG. 9 shows an embodiment similar to FIG. 8, in which the bounding wall 88 of the pocket 86 is open to the aft side of the hanger rail 48. This opening provides a coolant flow path even when the ring segments are tightly adjacent and are also tight against the inner surface 77 of the rail 48. The pocket 86 may be open to the front and/or aft side of the rail. If it is open to the front side, it provides film cooling over the joint between the ring segments as well as continued cooling to the backsides of the lips. Alternately, a front portion 89 of the bounding wall 88 may be disposed forward of the leading edge 66 (FIG. 3) of the front lip 44 of the ring segment 30A for this same purpose.

An embodiment of the invention may be implemented for example by modifying an outer support block in the stage 1 ring segment configuration of the General Electric (GE) PG7241 (7FA+e) combustion turbine frame. Adding the cooling channels 72 results in reduced operating temperatures and improved life of the stage 1 turbine ring segment assembly for the PG7241 unit. The added cooling channels reduce hot gas ingestion between the inner ring segment components. The cooling features result in lower ring segment operating temperatures, increased ring segment fatigue life and reduced risk of crack initiation as compared to the original equipment manufacturer (OEM) ring segment configuration. The OEM ring segment configuration does not utilize the cooling channels 72 as detailed in this invention.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. An outer structural block arranged to support a shroud ring assembly of a gas turbine engine, the outer structural block comprising:

a front hanger rail including a front face and a radially inner surface and arranged to at least partially support the shroud ring assembly; and a cooling channel arranged to direct a flow of fluid from an inlet formed in the front face to a first outlet formed in the radially inner surface, wherein the cooling channel comprises:

a main channel;

first and second tributary channels branching from respective first and second intersections on the main channel to the first outlet and to a second outlet respectively; and a plug positioned in the main channel to block the main channel downstream of the intersections, and wherein the first and second tributary channels each have a smaller diameter than the main channel, and the first and second intersections are offset from each other along a length of the main channel by a distance of at least one diameter of the main channel.

2. The outer structural block of claim 1, wherein the first outlet is directed toward a backside of a radially inner front lip of a shroud ring segment when the shroud ring segment is mounted on a mounting device, wherein the radially inner front lip extends forward of a front perimeter of a structural frame of the shroud ring segment and borders a combustion gas flow.

3. The outer structural block of claim 2, wherein the first outlet is directed toward a backside of a front corner of the radially inner front lip of the shroud ring segment.

4. The outer structural block of claim 1, wherein the first outlet and the second outlet are directed toward first and second adjacent radially inner front lips of respective first and second shroud ring segments engaged with the front hanger rail, wherein the first and second adjacent radially inner front lips extend forward of a front perimeter of a structural frame of the first and second shroud ring segments, and said first outlet and second outlet are located effective to impingement cool said first and second adjacent radially inner front lips.

5. An outer structural block for a shroud ring assembly of a gas turbine engine, comprising:

a shroud ring segment mounting device;

a cooling channel comprising a first outlet on a radially inner surface of a fore element of the shroud ring segment mounting device; and a second outlet of the cooling channel, wherein the first and second outlets are directed toward first and second adjacent radially inner front lips of respective first and second shroud ring segments when said shroud ring segments are mounted on the shroud ring segment mounting device, wherein the first and second adjacent radially inner front lips extend forward of a front perimeter of a structural frame of the shroud ring segment, and said first and second outlets are located effective to impingement cool said first and second adjacent radially inner front lips, wherein the fore element of the mounting device comprises a circumferentially oriented fore rail, the cooling channel comprises a coolant entrance on a front surface of the outer structural block, and the first and second outlets open into a pocket comprising a depressed area on a radially inner surface of the fore rail.

6. The outer structural block of claim 5, wherein the depressed area comprises a bounding wall that is open to an aft side of the fore rail, wherein a coolant fluid can escape aft from the pocket when said first and second adjacent radially inner front lips are adjacent and cover the pocket.

7. The outer structural block of claim 5, wherein the depressed area comprises a bounding wall, a front portion of which is open to a front side of the fore rail or is disposed forward of a front edge of the first and second adjacent radially inner front lips, wherein a coolant fluid can escape forward from the pocket and provide film cooling to the first and second adjacent radially inner front lips when said first and second adjacent radially inner front lips are adjacent and are against the inner surface of the fore rail.

8. The outer structural block of claim 5, wherein the depressed area comprises a substantially uniform shallow depth not greater than twice a diameter of either one of the first or second outlets.

9. In a ring segment assembly for a gas turbine engine comprising an outer structural block configured to connect to a casing of the engine and a plurality of inner ring segment components configured for adjacent engagement to the outer structural block via a forward hook arrangement and a rearward hook arrangement on the structural block, an improvement comprising:

a cooling channel comprising an inlet end on a forward face of the outer structural block and an outlet end proximate the forward end hook arrangement, the cooling channel configured to pressurize a gap between forward end corners of adjacent inner ring segment components when the gas turbine engine is operated, wherein the cooling channel includes a second opening that cooperates with the outlet end to impinge cooling fluid onto the adjacent forward end corners of the respective adjacent inner ring segment components, and wherein the second opening and the outlet end open into a pocket formed as a depression in a surface of the outer structural block.

10. The improvement of claim 9, wherein the depression is open to a front or aft side of the forward hook arrangement.

* * * * *